United States Patent [19]

Malphettes et al.

[11] 4,020,859

[45] May 3, 1977

[54] SYSTEM FOR CONTROLLING PRESSURE BY ACOUSTIC MEANS

[75] Inventors: Jean Malphettes; Pierre Fontanet, both of Versailles, France

[73] Assignees: Regie Nationale des Usines Renault, Paris; Automobiles Peugeot, Boulogne-Billancourt, both of France

[22] Filed: June 9, 1975

[21] Appl. No.: 584,936

Related U.S. Application Data

[62] Division of Ser. No. 361,064, May 17, 1973, Pat. No. 3,916,020.

[30] Foreign Application Priority Data

May 29, 1972 France ..... 72.19147

[52] U.S. Cl. ..... 137/14; 137/828; 137/206; 261/72 R

[51] Int. Cl.[2] ..... F02M 5/08

[58] Field of Search ..... 137/828, 13, 209, 206, 137/14

[56] References Cited

UNITED STATES PATENTS 3,413,996 12/1968 Fine ..... 137/828

*Primary Examiner*—Alan Cohan

*Attorney, Agent, or Firm*—Strauch, Nolan, Neale, Nies & Kurz

[57] ABSTRACT

A system for controlling pressure in a container, for example the carburetor of an internal combustion engine, from a periodic acoustic source, for example the intake or exhuast of the engine or a selected engine component where the alternating pressure varies only slightly according to engine speed where it is desired to modify the slope of a fuel richness curve over a wide operating range. The system is characterized in that it comprises a conduit connecting the container chamber to the acoustic source, the pressure losses being different according to the direction of flow in the conduit.

3 Claims, 2 Drawing Figures

SYSTEM FOR CONTROLLING PRESSURE BY ACOUSTIC MEANS

This application is a division of application Ser. No. 361,064, filed May 17, 1973 now U.S. Pat. No. 3,916,020.

BACKGROUND OF INVENTION

This invention relates to a method and apparatus for controlling pressure in containers from a periodic acoustic source.

It is well-known that a periodic acoustic phenomenon produces alternating pressure waves. It is also known that in heat engines, and particularly internal combustion engines, there are a large number of sources of periodic noise and that there are also pressure control problems, particularly as regards metering of the air-fuel mixture in the carburetion of internal combustion engines.

This invention utilizes the periodic acoustic phenomena produced by these engines or other acoustic sources to control the pressure in containers where it is required to effect a pressure correction.

Furthermore, in internal combustion engines used in motor vehicles, it is well-known that carburetion is frequently disturbed by acoustic phenomena produced by the engines. This invention proposes more particularly to obviate this type of disadvantage by making use of the acoustic phenomenon which produced the disturbance, in order to correct the effects of the latter.

The static positive or negative pressure increases rapidly with the alternating acoustic pressure and depends generally on the geometric features of the container system, the value of the ratio of the pressure loss coefficients, and the frequency of the alternating acoustic pressure of the periodic source.

SUMMARY OF THE INVENTION

According to the invention, a pressure control is effected in a container, such as the float chamber of an internal combustion engine carburetor, from a periodic acoustic source by connecting the container to the acoustic source by means of a conduit constructed so that the pressure losses differ according to the direction of flow through the conduit.

More specifically the conduit used in this invention is constructed so that the ratio of the pressure loss coefficients in one direction and the other direction is different from 1 so that the alternating acoustic pressure passing through the conduit and originating from the periodic acoustic source produces a static positive or negative pressure inside the container depending upon the value other than 1 of the said ratio.

A further object of this invention resides in providing a system for controlling pressure in a container from a periodic acoustic source by means of a conduit connecting the container to the acoustic source and so designed that the pressure losses inside the conduit differ according to the direction of flow inside the conduit.

Another object of this invention is to provide a control conduit for the system of the preceding object wherein the interior of the conduit comprises at least one air jet of the venturi type.

Still another object of this invention is to provide a control conduit, the inner wall of which comprises a series of steps of different diameters thus producing a very appreciable pressure loss in one direction and a small pressure loss in the other direction.

BRIEF DESCRIPTION OF THE DRAWINGS

Other objects will appear from the following description and appended claims when read in conjunction with the accompanying drawings wherein:

Figure 1:
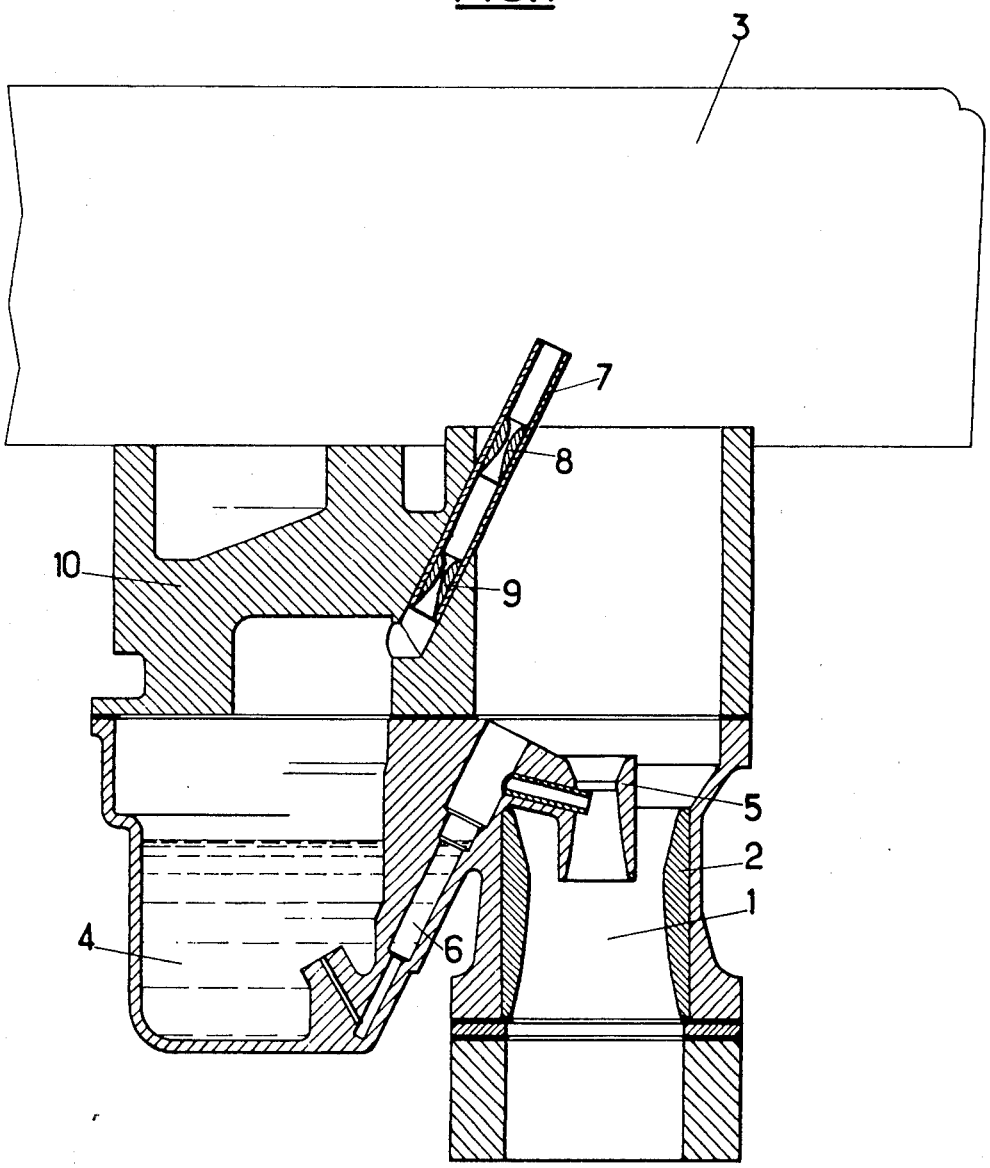
FIG. 1 is a diagrammatic section showing a first embodiment of the invention connecting a carburetor float chamber venting system to the intake of an internal combustion engine.

Referring to the drawings, the air inlet passage 1 and its associated venturi 2 are connected at one end to the air filter 3, of the periodic acoustic sources of an internal combustion engine, and at its other end to the intake manifold of the engine. The chamber 4, the float chamber of the carburetor, communicates with the jet 5 through the supply passage 6, the jet 5 discharging at the constricted section of the air passage 1.

Depending upon the position of the usual manual control butterfly valve (not shown in the drawings), conventionally situated downstream of air passage 1, the flow of air through filter 3 and along the passage 1 produced by operation of the engine creates a vacuum operative to induce a flow of fuel from passage 6 and atomization of the fuel to produce a metered mixture of the fuel from chamber 4 and air from the filter 3.

In embodiment shown in FIG. 1, the top part of chamber 4 is connected directly to the interior of air filter 3 by a smooth tube 7 containing two air jets 8 and 9 of the venturi type. Jets 8 and 9 are oriented in tube 7 in such a manner that the pressure loss coefficient for a flow of gas (air in this instance) through conduit 7 and jets 8 and 9 in the direction of chamber 4 is less than the pressure loss coefficient of a flow of the same gas through conduit 7 and jets 8 and 9 in the reverse direction from chamber 4 to the air filter 3. The ratio of the pressure loss coefficient in the direction of the acoustic source 3 to the pressure loss coefficient in the direction of chamber 4 is, therefore, greater than unity in the case of FIG. 1. Upon operation of the internal combustion engine, the acoustic alternating pressure waves which appear in air filter 3 and which are transmitted through jets 8 and 9 to chamber 4 result in a positive pressure in chamber 4 to increase the flow of fuel introduced through conduit 6 to the air passage 1.

As a result of this conduit and its association with filter 3 and float chamber 4, the assembly enables the intake resonance effects which would normally result in a mixture richness minimum, which is required to be limited, are counteracted. The correction provided by this invention is at all times proportional to the error, since the latter is a function of the amplitude of the alternating pressure which itself modulates the value of the correction.

In other words, the disclosed and claimed invention is the creation of a static pressure within a defined, closed space by connection of a conduit to a source of acoustic, dynamic pulsed pressure outside the space, the conduit having assymetric pressure loss characteristics, that is to say different pressure loss coefficients dependent on direction of flow through the conduit.

With this in mind, any one of ordinary skill in the art may obtain the desired results of the invention merely by computing the pressure and resolving simple, known mathematical considerations.

Specifically, the parameters to be considered and resolved can be stated as follows:

V = Volume of the closed space (chamber 4);

$\eta 1$ = Pressure loss coefficient, flow direction from the closed space (chamber 4) to outside of the space (e.g., air filter 3);

$\eta 2$ = Pressure loss coefficient, flow direction from the outside to the closed space;

$p$ = Variable pressure inside the closed space;

$P$ = Variable pressure outside the closed space;

M = Volume flow through the conduit, in either direction;

S = Cross sectional area of the conduit;

$\rho$ = Specific weight, gas flowing through the conduit; and $c$ = Sound velocity.

Simple physics dictates that the formula for determining the pressure difference for a flow directed from the closed space to the outside can be stated;

$$P - p = \rho\eta 1 \frac{M^2}{2S^2}$$

Conversely, for a flow from the outside to the closed space;

$$p - P = \rho\eta 2 \frac{M^2}{S^2}$$

Restated:

$$P - p = -\rho\eta 2 \frac{M^2}{S^2}$$

Pressure variations versus time according to a known adiabatic law may be stated:

$$\frac{dp}{dt} = \rho \frac{c^2 M}{V}$$

or $$M = \frac{V}{\rho c^2}\left(\frac{dp}{dt}\right)$$

Substituting and solving:

$$P - p = \eta \frac{V^2}{2\rho c^4 S^2} \frac{dp}{dt}$$

With:

$\eta = \eta_1$, if $P > p$

And:

$\eta = \eta_2$, if $P < p$

Again, any one of ordinary skill in the art may obtain the desired result merely by inserting determined values and resolving the derived equation.

DESCRIPTION OF ALTERNATE EMBODIMENT

Figure 2:
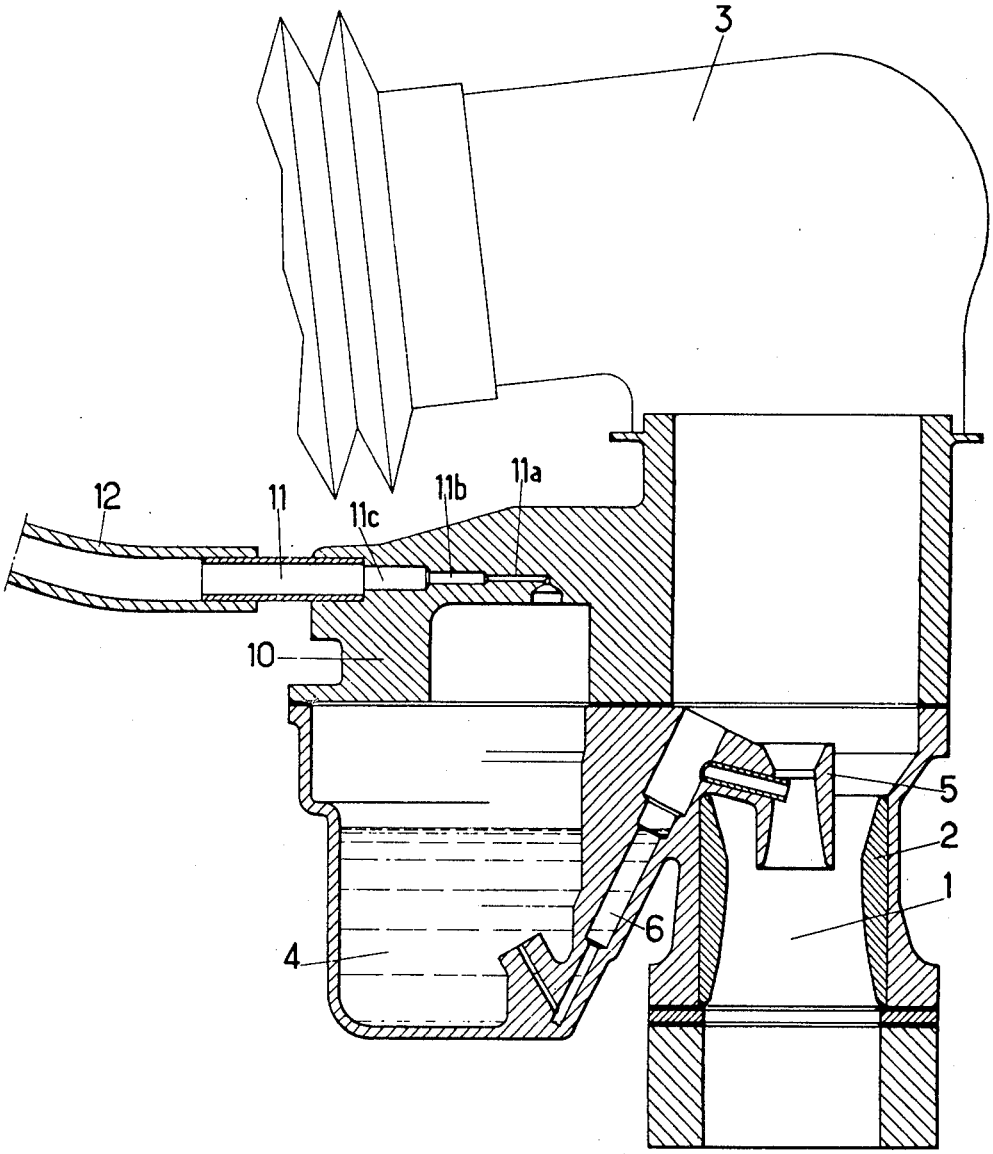
FIG. 2 is a diagrammatic section of a second embodiment of the invention connecting a carburetor float chamber venting system to the exhaust of an internal combustion engine.

In the alternate embodiment shown in FIG. 2, the lid 10 of float chamber 4 includes a conduit machined to provide a series of diameters 11*a*, 11*b* and 11*c* which increase in the outward direction. The venting conduit 11 fitted into the largest and outermost diameter 11*c*, may be connected through a flexible tube 12 to a point of the engine where a periodic acoustic source occurs, for example the engine intake or exhaust or any suitable component where the alternating pressure varies according to engine speed.

It will be apparent from FIG. 2 that the different diameters in machined conduit 11, 11*c*, 11*b* and 11*a*, produce a pressure loss coefficient which is higher in a direction of flow from chamber 4 to the acoustic source.

As in FIG. 1, the ratio of the pressure loss coefficient in the direction of the acoustic source to the pressure loss coefficient in the direction of chamber 4 is greater than unity and the periodic pressure waves produce a positive pressure in chamber 4 so that the rate of flow of fuel is increased.

The system and method of controlling pressure in a container in accordance with this invention may be used as illustrated particularly in the case of internal combustion engines to obviate the disadvantages due to intake resonance which may produce a richness maximum or a richness minimum in the air-fuel mixture. According to the invention is is in fact possible to provide a carburetor chamber venting conduit so that the rate of flow of the fuel is increased in the case where intake resonance results in a mixture of richness minimum.

Of course it would also be possible to provide a conduit in which the ratio of the pressure loss coefficients would be less than unity, for example by a reversal of jets 8 and 9 or the series of diameters 11*a*, 11*b* and 11*c*, so that the alternating pressure waves would in that case produce a negative pressure in the carburetor float chamber. This could be used to obviate a richness maximum produced by an intake resonance.

The system according to the invention may also be used to modify the slope of a richness curve over a wide operating range. If it is found in a given engine that the mixture richness is excessive over an appreciable range, for example at low engine speeds, the pressure loss in the float venting conduit may be so devised as to produce a negative pressure in the carburetor float chamber, this having the effect of compensating for the excess richness. In that case, the alternating acoustic source will preferably be a component of the engine where the alternating pressure varies only slightly according to engine speed. In this way the negative pressure produced in the carburetor float chamber by means of the system according to the invention will be practically constant irrespective of engine speed.

Since the negative pressure between the chamber and the air tube acting on the rate of fuel flow during normal operation of the carburetor increases with engine speed, the compensating effect of the system according to the invention will decrease when the speed increases, and in this way it will be possible regularly to reduce the richness of the mixture at low speeds, while retaining the engine operation unchanged at higher speeds.

The system and the method according to the invention are of particularly advantageous application in controlling carburetion in internal combustion engines and particularly in the carburetor float chamber venting conduits.

The invention may also be used whenever it is required to carry out pressure control in a container and it is possible to use a periodic acoustic source.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of continuously controlling pressure of a fluid in a chamber from a periodic acoustic source, comprising the steps of: selecting a variable, periodic acoustic source; connecting the chamber to the periodic source through a single conduit having means for establishing a first pressure loss for said fluid flowing from said acoustic source into said chamber and a second pressure loss for fluid flowing from said chamber into said acoustic source, said first and second pressure losses being different; orienting the conduit to establish a flow therethrough in a preselected direction; varying the amplitude of the acoustic source and continuously utilizing said periodic source to modulate the pressure of fluid in the chamber as a function of the amplitude of the acoustic source.

2. The method of claim 1 wherein said first pressure loss is smaller than said second pressure loss, and the connection of the alternate periodic acoustic source is selected to produce a static positive pressure inside said chamber.

3. The method of claim 1, wherein said first pressure loss is greater than said second pressure loss and the connection to the alternate periodic acoustic source is selected to produce a static negative pressure inside said chamber.

* * * * *